US012742462B1

(12) United States Patent
Ledford et al.

(10) Patent No.: US 12,742,462 B1
(45) Date of Patent: Sep. 22, 2026

(54) SUBMERSIBLE PUMP HOUSING

(71) Applicant: Turtle Pump Company LLC, Florissant, CO (US)

(72) Inventors: Gary Alan Ledford, Florissant, CO (US); Christopher Albert Wiese, Cascade, CO (US)

(73) Assignee: Turtle Pump Company LLC, Florissant, CO (US)

( * ) Notice: Subject to any disclaimer, the term of this patent is extended or adjusted under 35 U.S.C. 154(b) by 0 days.

(21) Appl. No.: 19/391,489

(22) Filed: Nov. 17, 2025

Related U.S. Application Data

(63) Continuation-in-part of application No. 30/030,314, filed on Oct. 29, 2025.

(51) Int. Cl.

| | |
|---|---|
| ***F04D 29/70*** | (2006.01) |
| ***F04D 3/00*** | (2006.01) |
| ***F04D 29/52*** | (2006.01) |
| ***F04D 29/66*** | (2006.01) |

(52) U.S. Cl.
CPC ..... *F04D 29/708* (2013.01); *F04D 3/00* (2013.01); *F04D 29/528* (2013.01); *F04D 29/669* (2013.01)

(58) Field of Classification Search
CPC ..... F04D 29/708; F04D 29/528; F04D 3/00; F04D 29/669
USPC ..... 417/423.3
See application file for complete search history.

(56) References Cited

U.S. PATENT DOCUMENTS

| | | | | |
|---|---|---|---|---|
| 1,696,776 | A | 12/1928 | Menge | |
| 2,881,707 | A | 4/1959 | Thompson | |
| 3,093,156 | A | 6/1963 | Nielsen | |
| 4,098,557 | A | 7/1978 | Claunch et al. | |
| 4,308,138 | A * | 12/1981 | Woltman | C02F 1/50 210/220 |
| 10,882,593 | B1 | 1/2021 | Ledford | |
| 10,927,653 | B2 * | 2/2021 | Brown | E21B 43/38 |
| 12,071,954 | B1 | 8/2024 | Ledford | |
| 2015/0275855 | A1 | 10/2015 | Pal et al. | |
| 2022/0412376 | A1 * | 12/2022 | Schraiber | F04D 29/708 |

* cited by examiner

*Primary Examiner* — Michael L Sehn

(57) ABSTRACT

A submersible pump housing is a device that increases the pumping capacity and the power efficiency of a recirculating pump. The device includes an inlet converging nozzle, a tubular casing, an intermediate converging nozzle, a housing outlet, and an internal hub. The inlet converging nozzle facilitates the inflow of fluid from the surroundings and improves the fluid flow moving into the device. The tubular casing provides the space necessary to house the pump motor and affects the fluid moving through the device to improve the efficiency of the recirculating pump. The intermediate converging nozzle guides the flow moving through the device from the tubular casing towards the housing outlet. The housing outlet facilitates the fluid outflow from the device and houses the propeller or impeller of the recirculating pump (i.e., the peller). The internal hub facilitates the operational mounting of the pump motor and the peller within the device.

10 Claims, 19 Drawing Sheets

SUBMERSIBLE PUMP HOUSING

The current application is a continuation-in-part (CIP) application of the U.S. design application Ser. No. 30/030,314 filed on Oct. 29, 2025.

FIELD OF THE INVENTION

The present invention relates generally to submersible pumps and aquaculture systems. More specifically, the present invention provides a more energy-efficient and higher capacity submersible pump.

BACKGROUND OF THE INVENTION

The concept for moving recirculated water through fish hatcheries is not new and has been widely implemented due to the benefits of doing so. Generally, a recirculating pump is utilized to drive the water flow through the fish hatcheries. Recirculating pumps with different specifications have been made available to accommodate the varying capacity of fish hatcheries. Over the years, power consumption and pumping capacity are the two main factors that have been developed the most. High-capacity pumps often utilize a lot of power and have a high footprint which can be inadequate for fish hatcheries with limited space and power. So, a more energy efficient, high capacity, and low footprint recirculating pump is necessary and beneficial.

The present invention provides a submersible pump housing designed for submersible pumps that are more energy-efficient and has higher capacity than what is currently on the market. The present invention eliminates the problems found in existing pumps such as cavitation and flow separation while also significantly boosting performance of the submersible pump. Further, the present invention can be provided with a smaller footprint that significantly increases the potential of the submersible pump to be used in a wide variety of applications thanks to the lower energy demands, greater performance capabilities, and minimal cost. Additional features and benefits of the present invention are further discussed in the sections below.

SUMMARY OF THE INVENTION

The present invention provides a submersible pump housing that increases the pumping capacity, reduces the power consumption, and lowers the footprint of the corresponding submersible pump. In general, the present invention includes an internal hub designed to facilitate the mounting of a pump motor within the submersible pump housing. The internal hub also facilitates the torsional connection of the mounted pump motor to a propeller or impeller, preferably referred to as a "peller." The present invention further comprises a housing outlet specifically designed to house the peller. An intermediate converging nozzle is also implemented on the submersible pump housing between the internal hub and the housing outlet. The intermediate converging nozzle helps improve fluid dynamics before the fluid reaches the peller. Further, the present invention includes an inlet converging nozzle that also improves the fluid dynamics as the fluid enters the submersible pump housing. A tubular casing is also provided between the inlet converging nozzle and the internal hub that ensures a uniform flow profile and velocity. The pump motor is also positioned within the tubular casing.

In some embodiments, the present invention can further include a screen filter that keeps out unwanted objects, materials, and contaminants from the fluid entering the submersible pump housing. The screen filter also elevates the inlet converging nozzle from the ground to further facilitate the flow of fluid into the submersible pump housing. Further, the present invention can include a tubular pipe adapter that facilitates the fluid connection of the housing outlet to an external outlet pipe. Different types of adapters can be provided for the tubular pipe adapter. Both the screen filter and the tubular pipe adapter are provided as modular components that can be selectively connected and disconnected from the submersible pump housing. This way, the submersible pump housing can be easily disconnected from the external outlet pipe for different purposes such as maintenance of the peller and the pump motor.

DETAILED DESCRIPTION OF THE INVENTION

Figure 1:
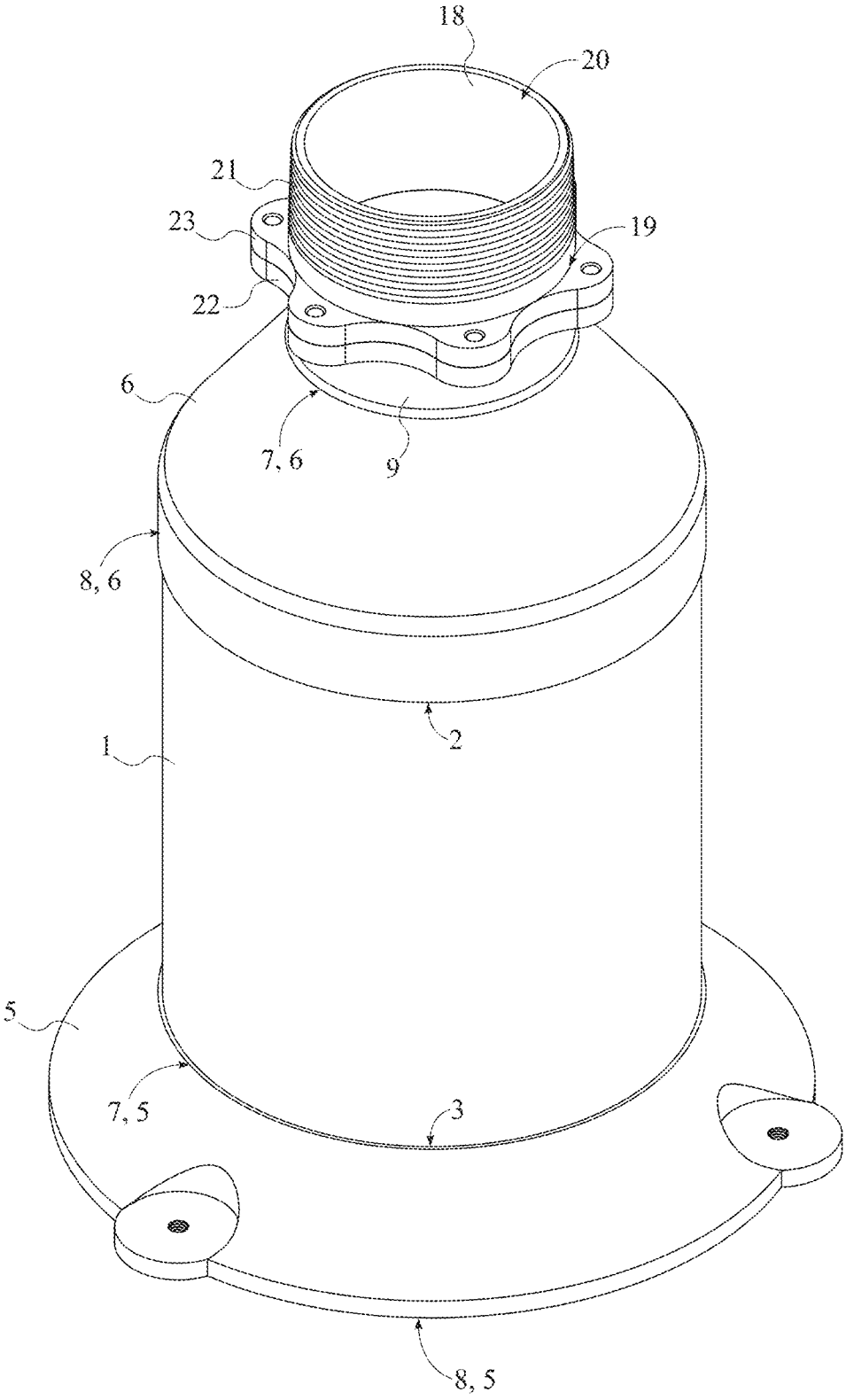
FIG. 1 is a top-front-left perspective view of the present invention, wherein the submersible pump housing is shown with a tubular pipe adapter.
Figure 2:
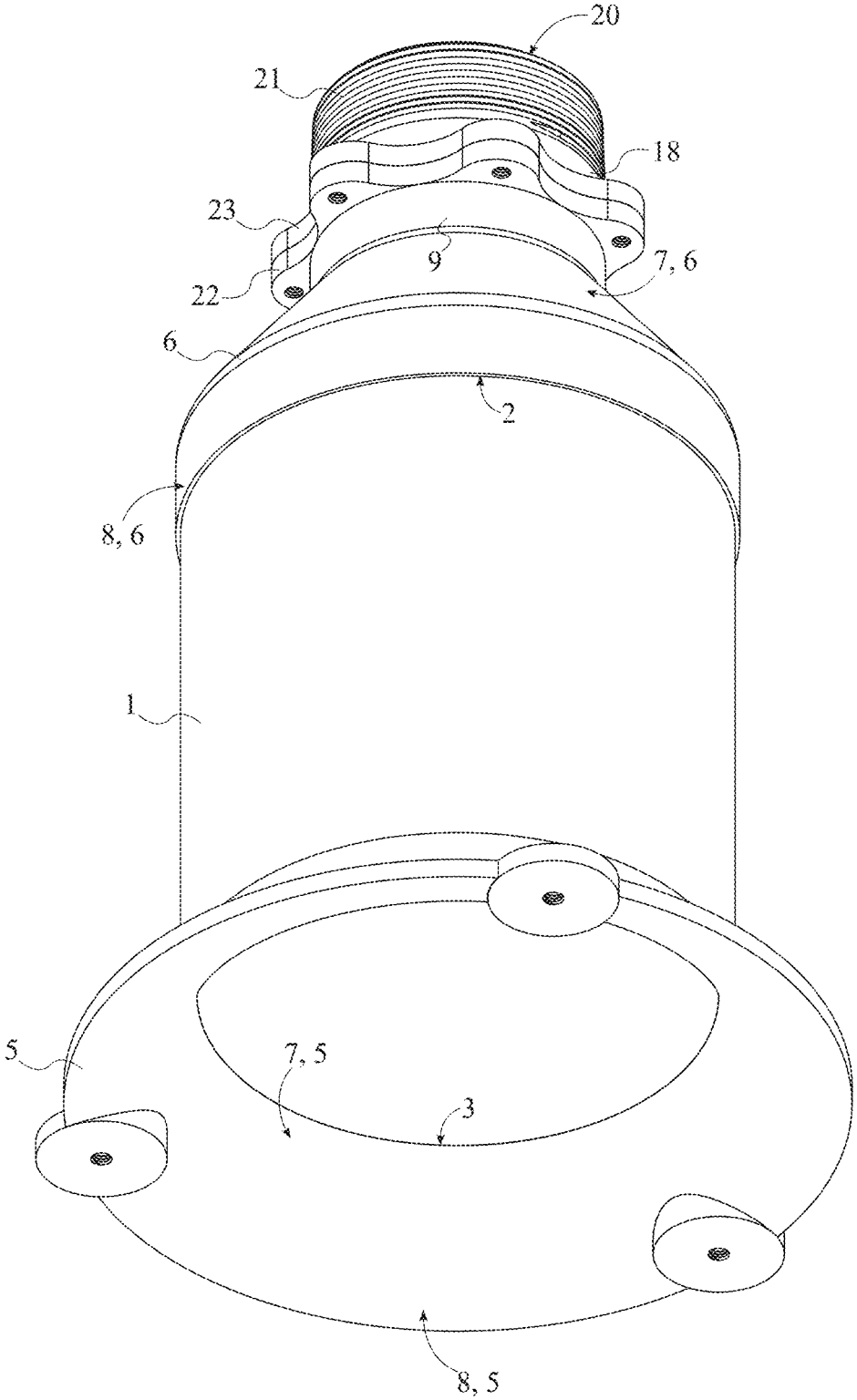
FIG. 2 is a bottom-rear-right perspective of the present invention thereof.
Figure 3:
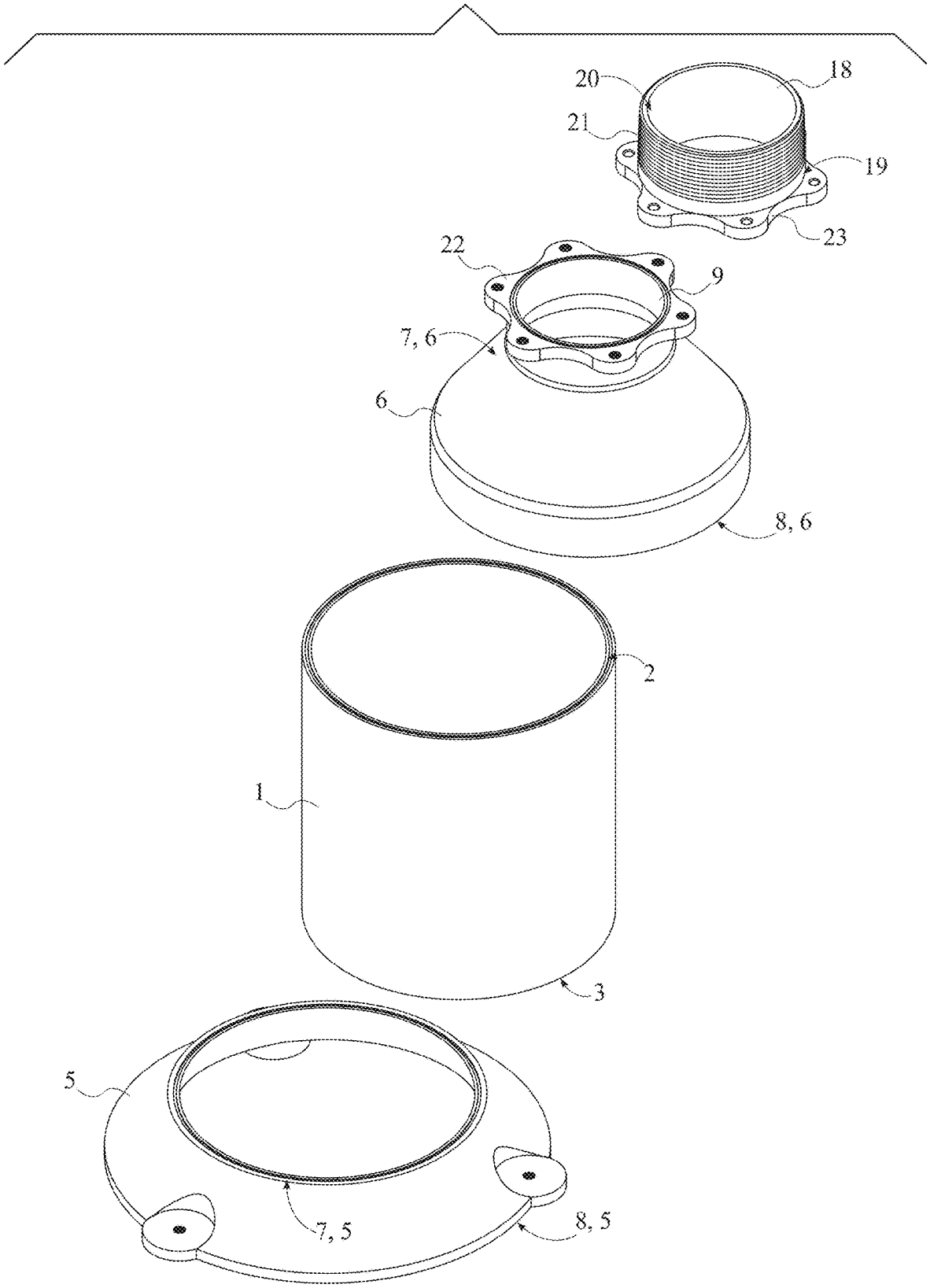
FIG. 3 is a top-front-left exploded perspective view of the present invention thereof.
Figure 4:
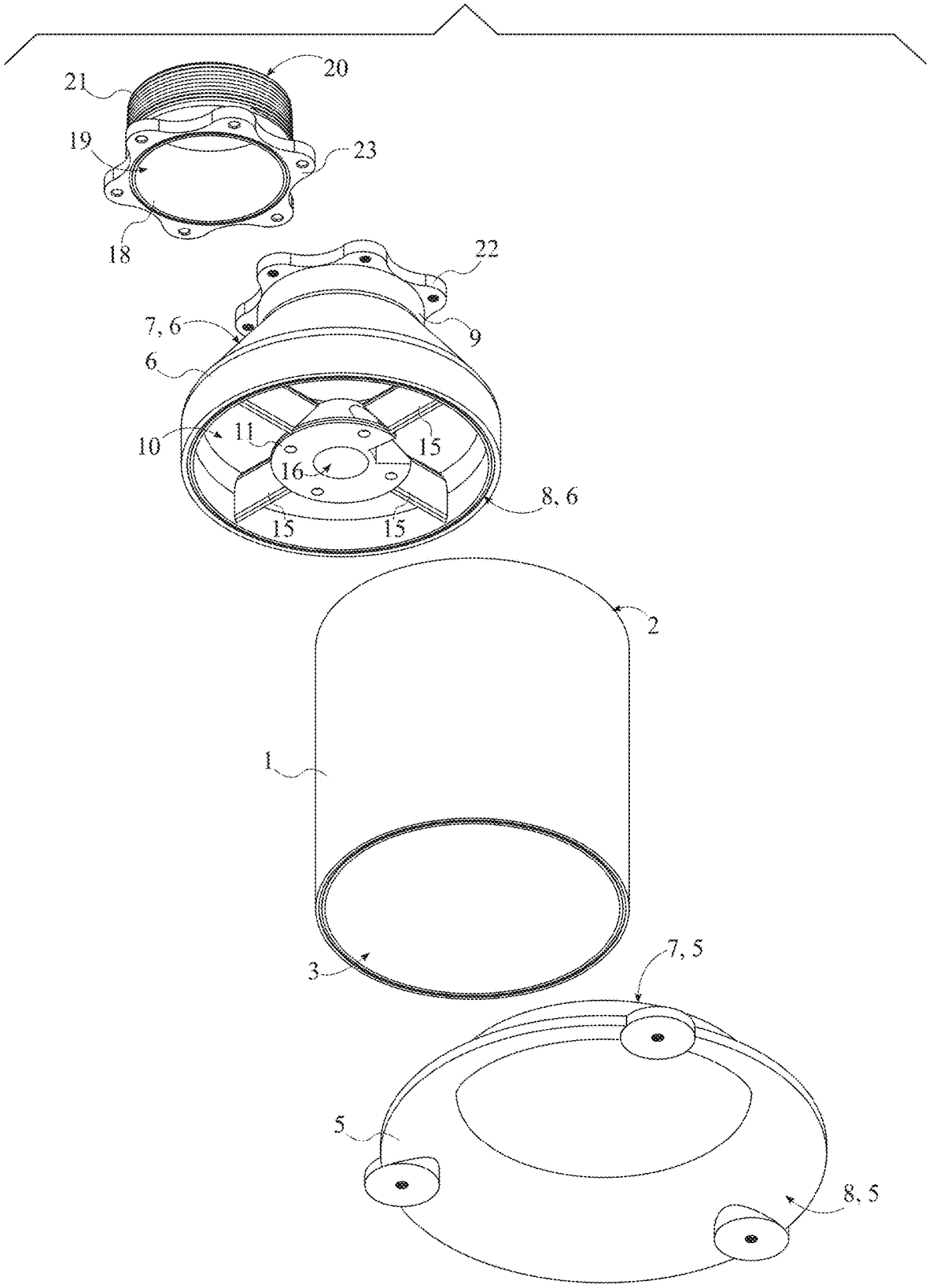
FIG. 4 is a bottom-rear-right exploded perspective view of the present invention thereof.
Figure 5:
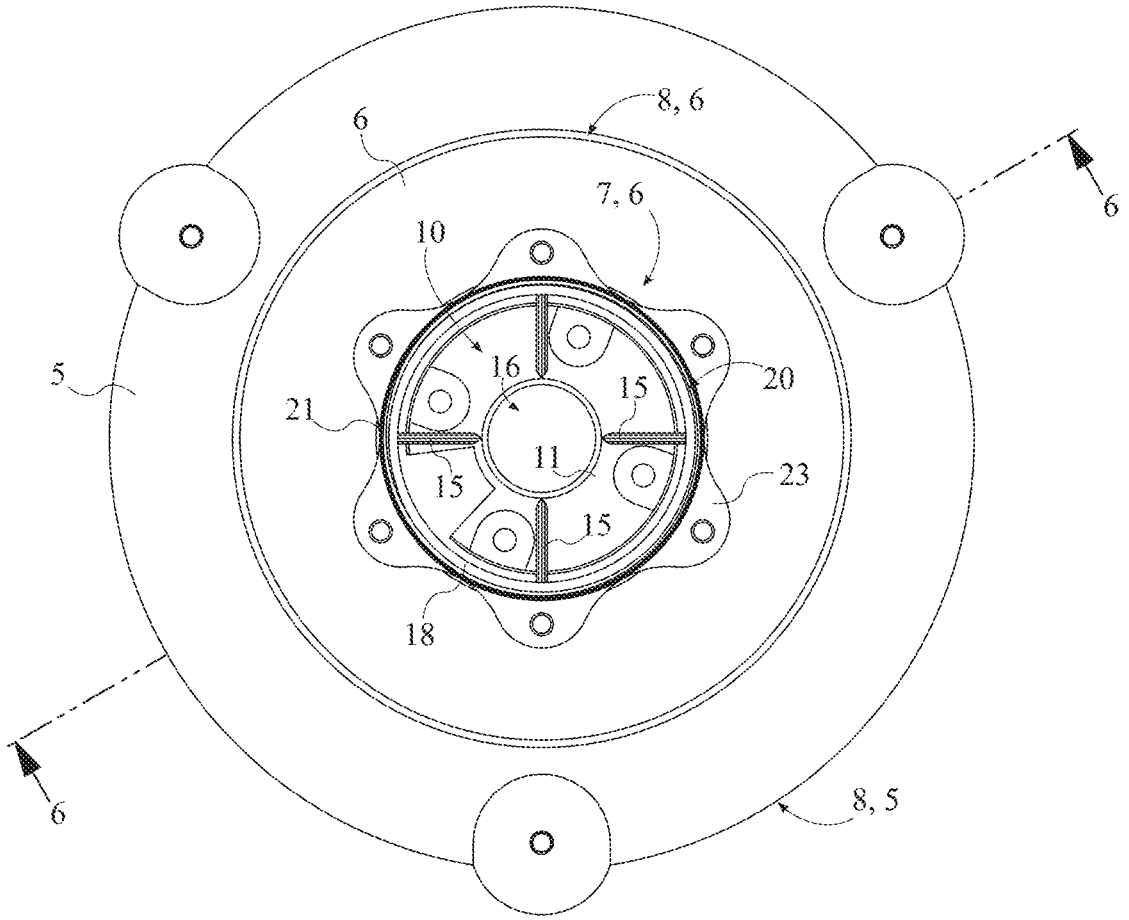
FIG. 5 is a top view of the present invention thereof.
Figure 6:
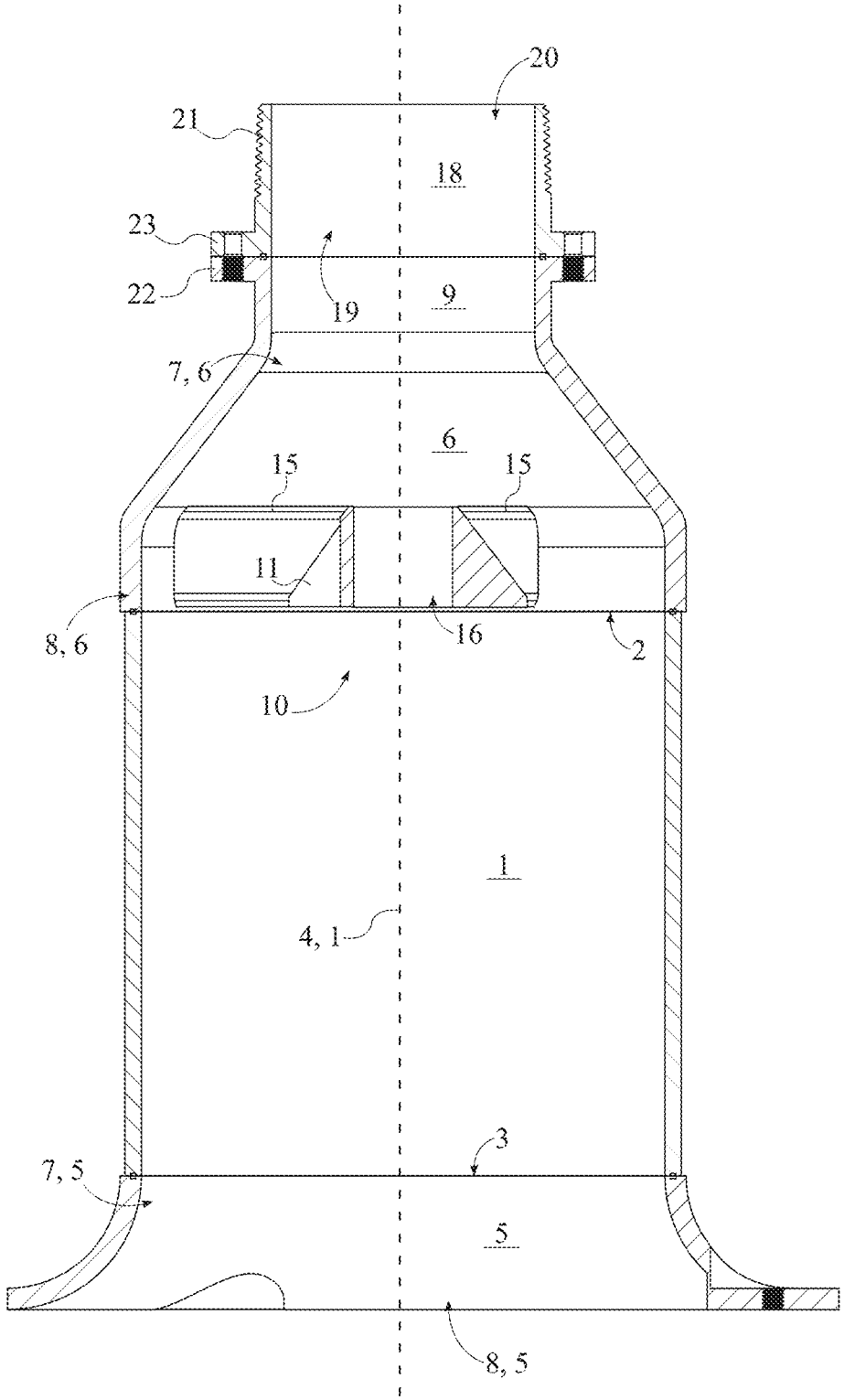
FIG. 6 is a cross-sectional view taken along line 6-6 in FIG. 5.
Figure 7:
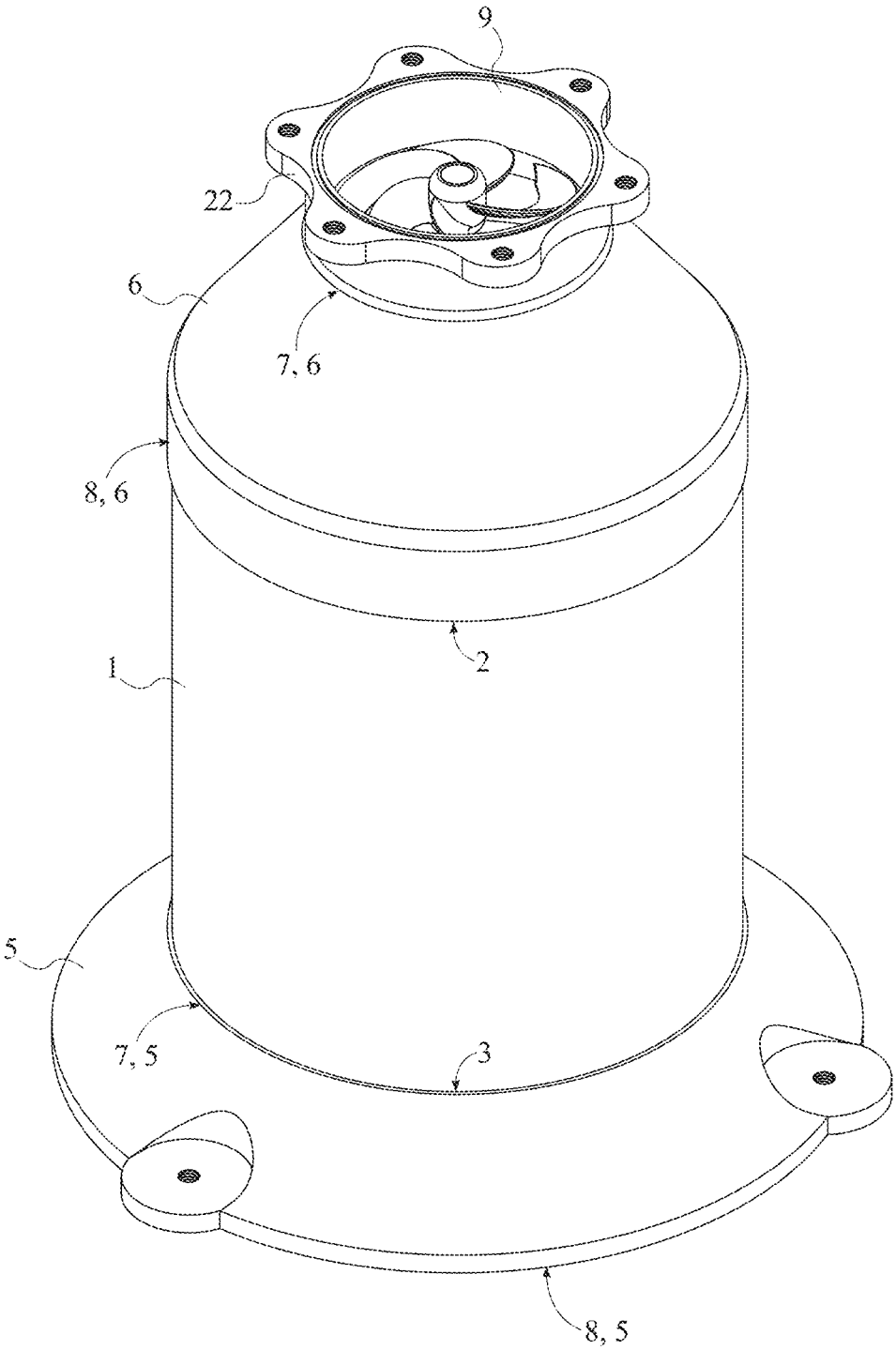
FIG. 7 is a top-front-left perspective view of the present invention, wherein the submersible pump housing is shown with a pump motor and a pump peller.

All illustrations of the drawings are for the purpose of describing selected versions of the present invention and are not intended to limit the scope of the present invention.

The present invention provides a submersible pump housing. The submersible pump housing is designed to increase the pumping capacity and the power efficiency of a recirculating pump. In the preferred embodiment, the present invention comprises an inlet converging nozzle 5, a tubular casing 1, an intermediate converging nozzle 6, a housing outlet 9, and an internal hub 10, as can be seen in FIGS. 1 through 19. The inlet converging nozzle 5 facilitates the inflow of fluid into the present invention from the surroundings. The inlet converging nozzle 5 also improves the flow of the fluid moving into the present invention. The tubular casing 1 provides the space necessary to house the pump motor within the present invention. The tubular casing 1 also affects the fluid moving through the present invention to improve the efficiency of the recirculating pump. The intermediate converging nozzle 6 guides the flow moving through the present invention from the tubular casing 1 towards the housing outlet 9. The housing outlet 9 facilitates the outflow of the fluid moving through the present invention. The housing outlet 9 also houses the propeller or impeller of the recirculating pump, preferably referred to as the "peller." The internal hub 10 facilitates the operational mounting of the pump motor and the peller within the present invention.

The general configuration of the aforementioned components improves the pumping capacity and power efficiency of a recirculating pump while reducing the overall footprint of the recirculating pump. As previously discussed, the inlet converging nozzle 5 and the intermediate converging nozzle 6 are designed to affect the fluid flow through the present invention. Both the inlet converging nozzle 5 and the intermediate converging nozzle 6 are designed to improve the fluid dynamics at the corresponding sections of the present invention. In general, the inlet converging nozzle 5 and the intermediate converging nozzle 6 each comprises a lower-pressure section 7 and a higher-pressure section 8 corresponding to the two opposing sides of each converging nozzle, as can be seen in FIGS. 1 through 19. Due to the converging shape, the fluid moving through each converging nozzle accelerates which results in the fluid pressure to decrease. This results in the formation of the lower-pressure section 7 and the higher-pressure section 8 in each converging nozzle. Further, the tubular casing 1 is designed as a straight cylindrical casing with a size large enough to accommodate the pump motor. So, the tubular casing 1 comprises a proximal open end 2 and a distal open end 3 corresponding to the opposite open ends of the tubular casing 1.

The present invention can be implemented as follows: the lower-pressure section 7 of the intake converging nozzle is in fluid communication with the distal open end 3 to allow the fluid flow to move from the inlet converging nozzle 5 to the tubular casing 1, as can be seen in FIGS. 1 through 19. On the other hand, the proximal open end 2 is in fluid communication with the lower-pressure section 7 of the intermediate converging nozzle 6 to allow the fluid flow to move from the tubular casing 1 to the intermediate converging nozzle 6. Further, the higher-pressure section 8 of the intermediate converging section is in fluid communication with the housing outlet 9 to allow the fluid flow to move from the intermediate converging nozzle 6 to the housing outlet 9. Thus, a solid housing structure that takes advantage of the Venturi effects is formed.

Further, the internal hub 10 is mounted within the intermediate converging nozzle 6, adjacent to the tubular casing 1, to provide structural support to the pump motor and the peller without obstructing the operation of the pump motor not the peller, as can be seen in FIGS. 1 through 19. The internal hub 10 is designed in such a way that the mounted pump motor is positioned within the tubular casing 1 and the peller is positioned within the housing outlet 9. The internal hub 10 also allows the torsional connection of the pump motor to the peller through the internal hub 10. Furthermore, the inlet converging nozzle 5, the intermediate converging nozzle 6, the internal hub 10, and the housing outlet 9 are concentrically positioned along a central axis 4 of the tubular casing 1 to form an overall elongated cylindrical structure.

In the preferred embodiment, the internal hub 10 is designed to match the design structure of the intermediate converging nozzle 6. This ensures that the internal hub 10 does not affect the fluid dynamics through the intermediate converging nozzle 6. As can be seen in FIGS. 10 through 13, the internal hub 10 preferably comprises a truncated conical body 11 with a size smaller than the intermediate converging nozzle 6. The truncated conical body 11 comprises a proximal conical base 12, a distal conical base 13, and a conical lateral wall 14. The proximal conical base 12 and the distal conical base 13 correspond to the opposite flat bases of the truncated conical body 11, while the conical lateral wall 14 corresponds to the conical surface.

As can be seen in FIGS. 10 through 13, the truncated conical body 11 of the internal hub 10 can be implemented as follows: the conical lateral wall 14 tapers from the distal conical base 13 to the proximal conical base 12 to form the truncated design of the internal hub 10. The taper angle of the conical lateral wall 14 preferably matches the taper angle of the intermediate converging nozzle 6. Further, the distal conical base 13 is oriented towards the tubular casing 1, while the proximal conical base 12 is oriented towards the housing outlet 9. This way, the truncated conical body 11 matches the orientation of the intermediate converging nozzle 6. Furthermore, the truncated conical body 11 is concentrically positioned along the central axis 4 of the tubular casing 1 to match the cylindrical arrangement of the present invention.

Different support mechanisms can be implemented to mount the internal hub 10 within the intermediate converging nozzle 6. However, the support mechanism utilized must not affect the fluid flow through the present invention. In the preferred embodiment, the internal hub 10 may further comprise a plurality of support vanes 15 that help mount the truncated conical body 11 to the interior of the intermediate converging nozzle 6, as can be seen in FIGS. 10 through 13. Each of the plurality of support vanes 15 is designed to condition the flow of the fluid moving through the intermediate converging nozzle 6. In general, each of the plurality of support vanes 15 is designed as flat elongated vane with sharp edges that help guide the fluid flow around the corresponding support vane. So, each of the plurality of support vanes 15 comprises a first vane end 28 and a second vane end 29 corresponding to the terminal ends of each support vane.

As can be seen in FIGS. 10 through 13, the plurality of support vanes 15 can be implemented as follows: the plurality of support vanes 15 is radially distributed around the truncated conical body 11 to evenly support the truncated conical body 11. The radial distribution of the plurality of support vanes 15 depends on the number of support vanes implemented which can vary according to the overall capacity of the present invention. Further, the first vane end 28 of each of the plurality of support vanes 15 is connected onto the conical lateral wall 14 to secure the plurality of support vanes 15 to the truncated conical body 11. On the other hand, the second vane end 29 of each of the plurality of support vanes 15 is connected onto the intermediate converging nozzle 6 to secure the plurality of support vanes 15 to the intermediate converging nozzle 6. This way, the truncated conical body 11 is properly mounted within the intermediate converging nozzle 6 without affecting the fluid flow.

As previously discussed, the internal hub 10 is designed to support the operation of the pump motor while also allowing the torsional connection of the peller to the pump motor. To do so, the internal hub 10 may further comprise a central channel 16 that accommodates the motor shaft of the pump motor, as can be seen in FIGS. 8 through 13. The overall size of the central channel 16 depends on the dimensions of the motor shaft. To implement the central channel 16, the central channel 16 traverses from the proximal conical base 12, through the truncated conical body 11, and out of the distal conical base 13. This forms a through hole that allows the motor shaft to be pass through the truncated conical body 11. Further, the central channel 16 is concentrically positioned along the central axis 4 of the tubular casing 1 to center the motor shaft along the cylindrical structure of the present invention.

To further facilitate the mounting of the pump motor to the internal hub 10, the internal hub 10 may further comprise a plurality of hub fastening features 17, as can be seen in FIGS. 8 through 13. The plurality of hub fastening features 17 preferably corresponds to several fastener holes designed to receive the appropriate fasteners that secure the pump motor to the internal hub 10. To implement the plurality of hub fastening features 17, the plurality of hub fastening features 17 is radially distributed around the truncated conical body 11. This enables the pump motor to be evenly secured to the truncated conical body 11 to prevent malfunctions and maintain the motor shaft centered. Further, each of the plurality of hub fastening features 17 is integrated in between the conical lateral wall 14 and the distal conical base 13. Depending on the type of fastening feature, the plurality of hub fastening features 17 may be integrated differently. For example, if the plurality of hub fastening features 17 includes fastener holes, each fastener hole traverses into the distal conical base 13, through the truncated conical body 11, and out through conical lateral wall 14.

Figure 8:
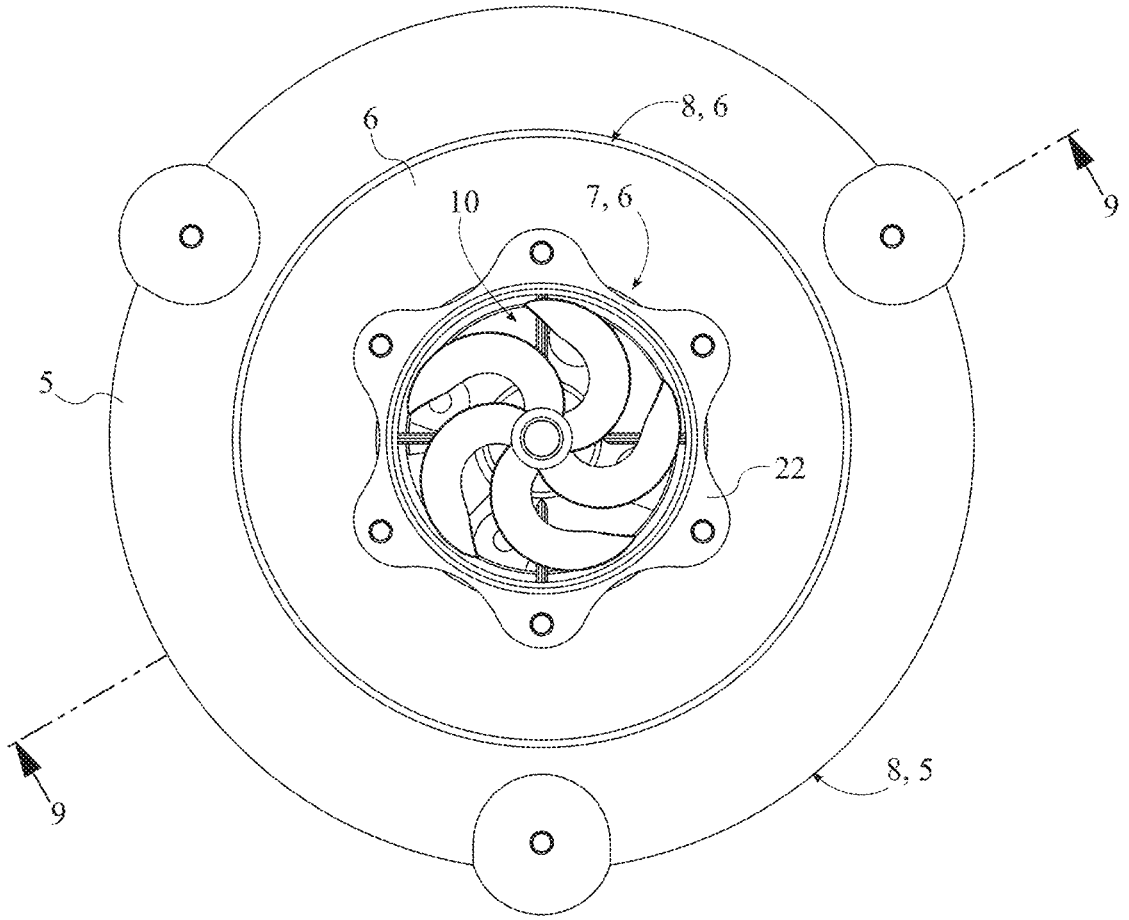
FIG. 8 is a top view of the present invention thereof.
Figure 9:
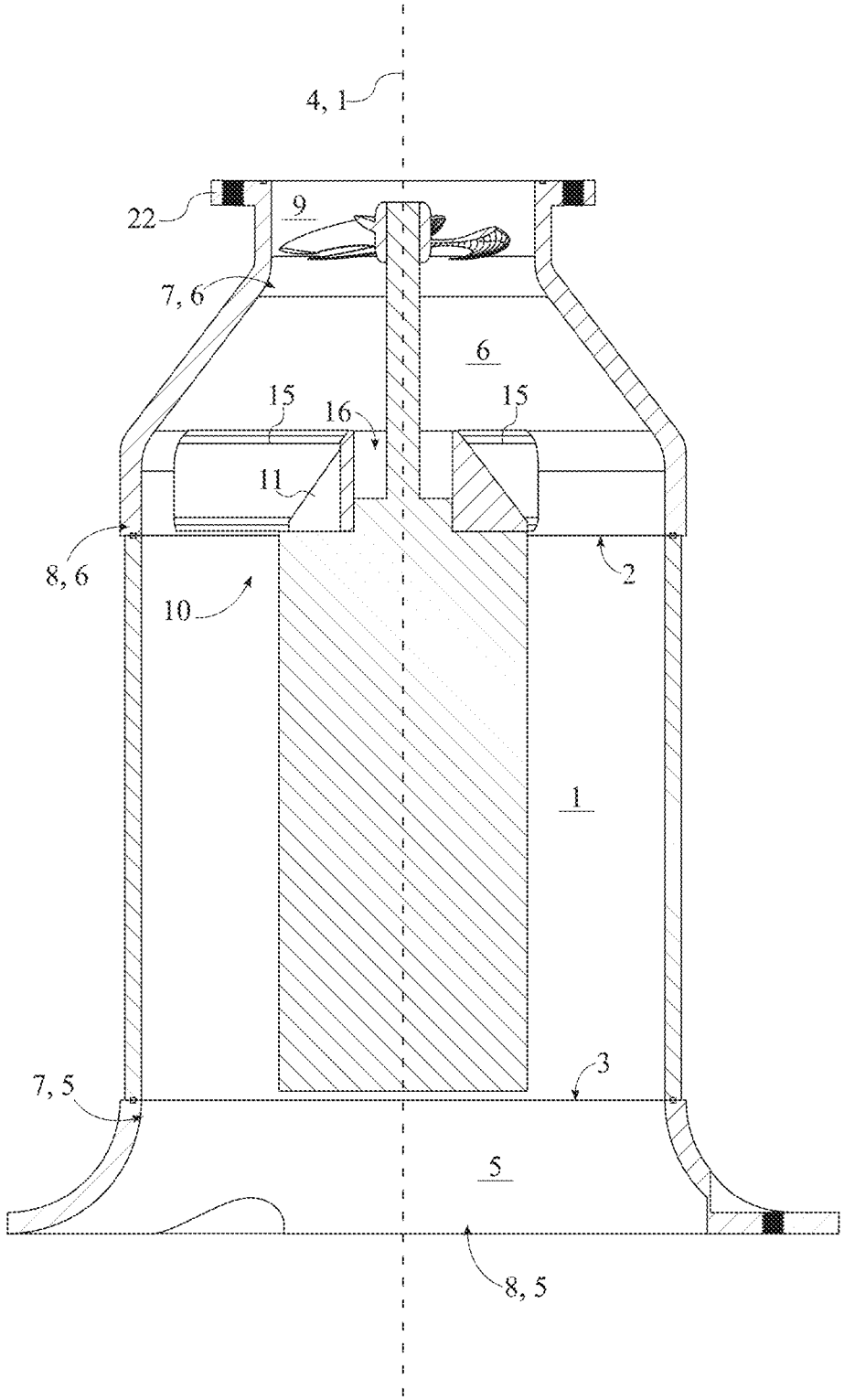
FIG. 9 is a cross-sectional view taken along line 9-9 in FIG. 8.
Figure 10:
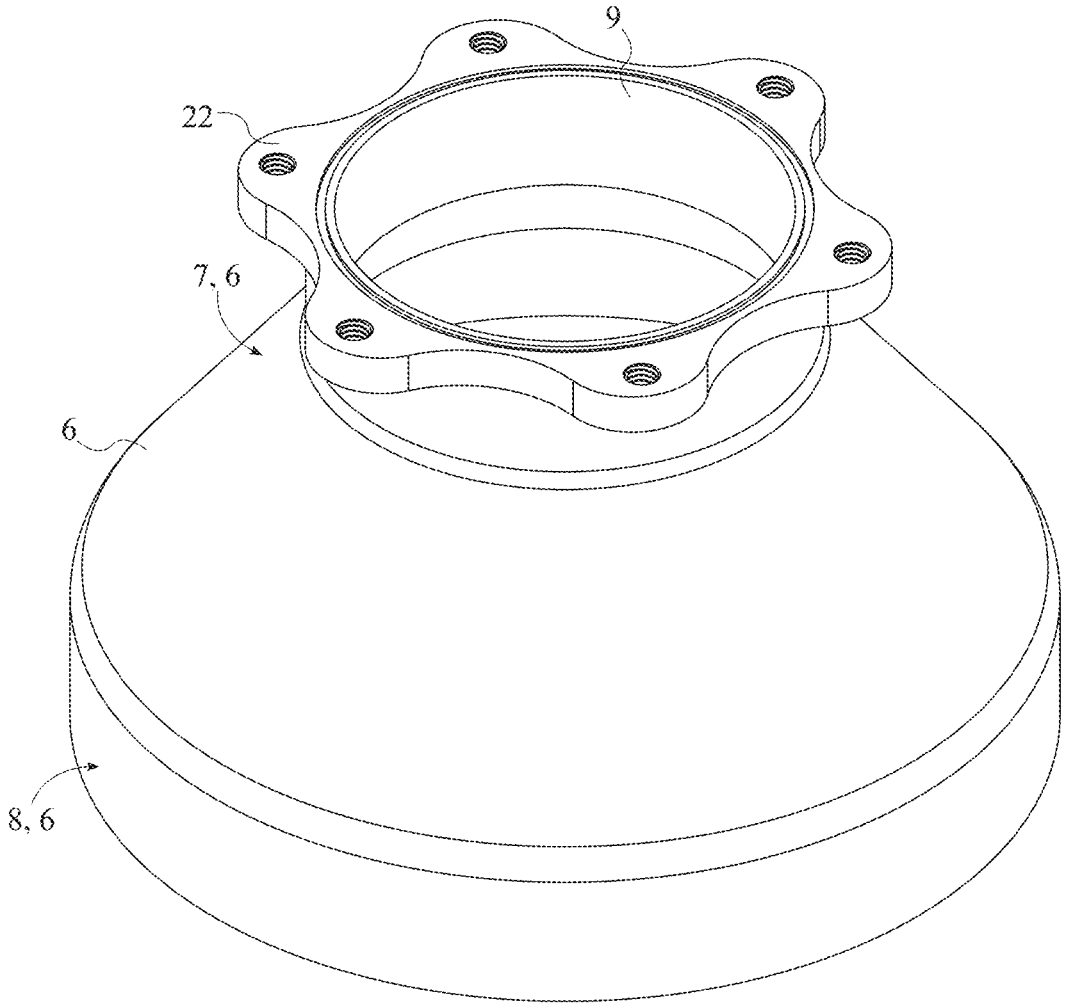
FIG. 10 is a top-front-left perspective view of the intermediate converging nozzle and the housing outlet of the present invention.
Figure 11:
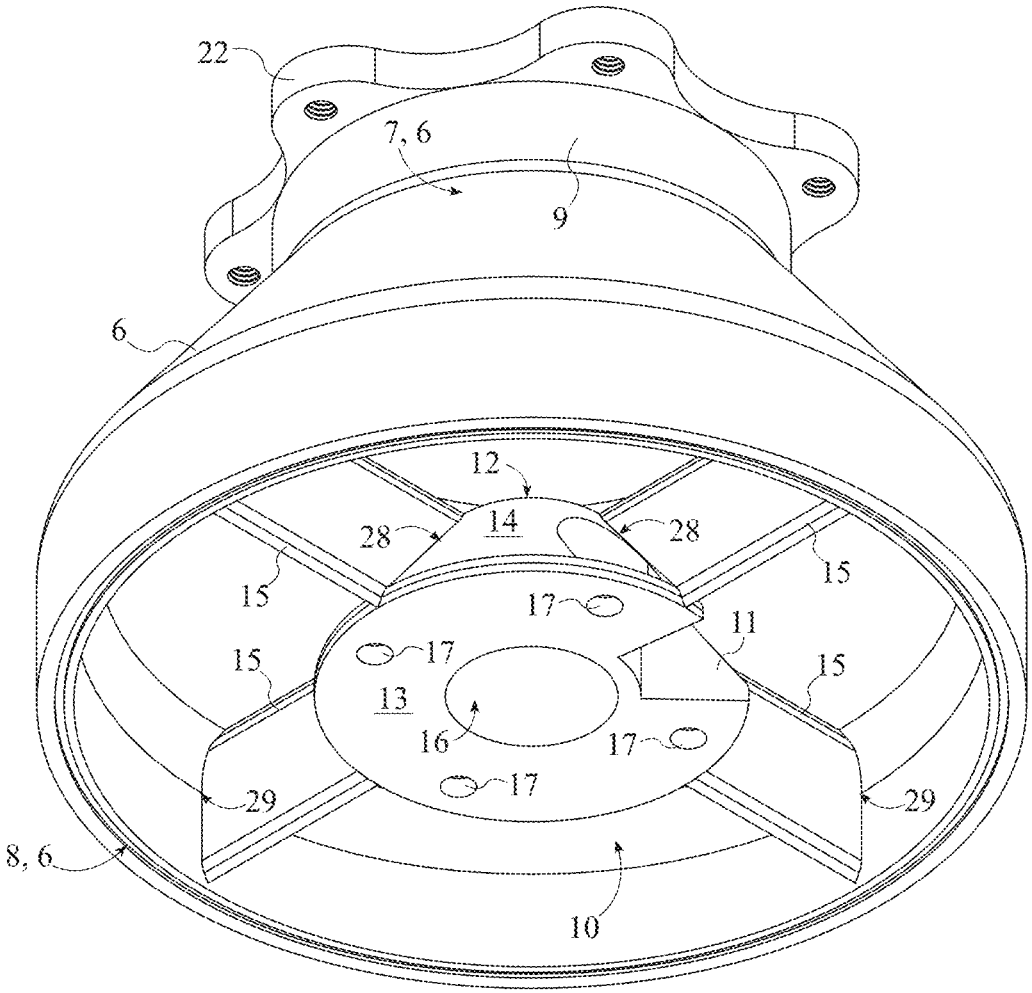
FIG. 11 is a bottom-rear-right perspective of the intermediate converging nozzle and the housing outlet of the present invention.
Figure 12:
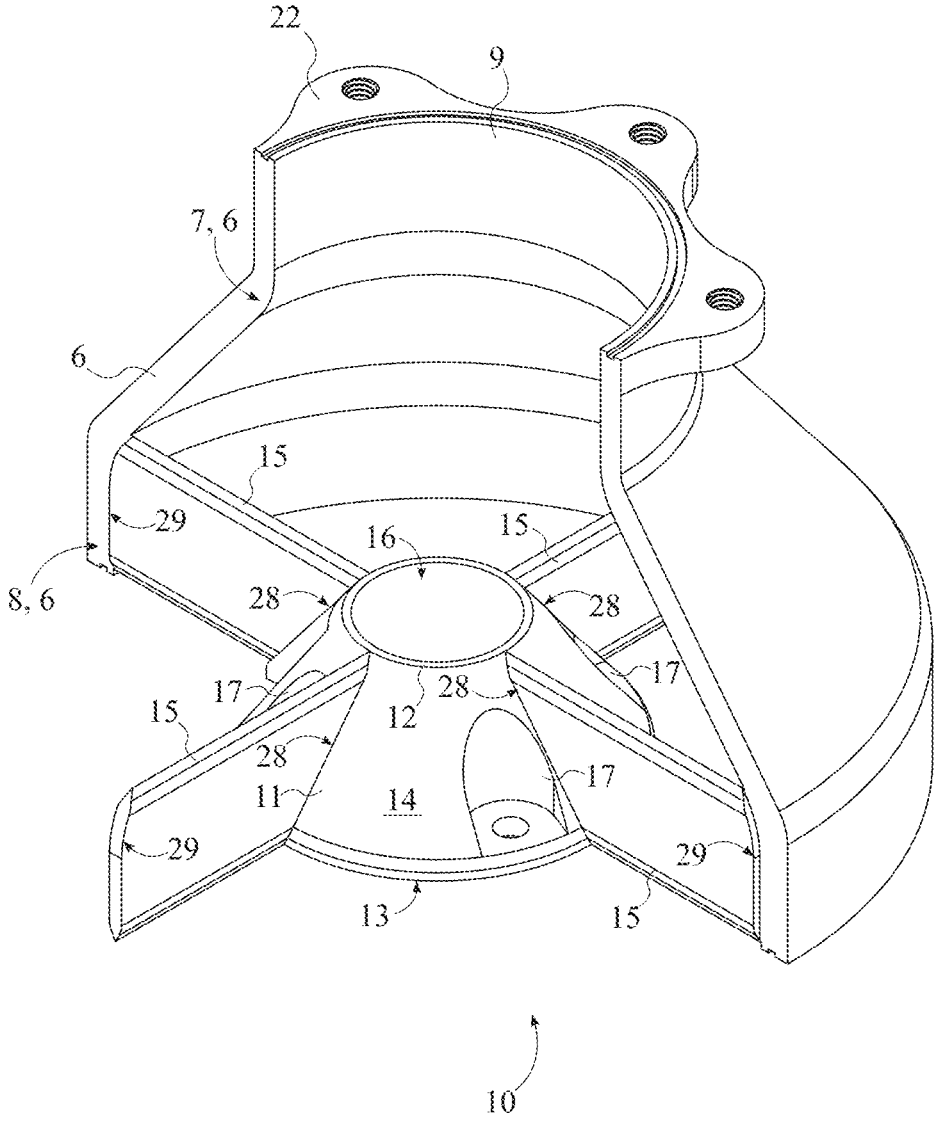
FIG. 12 is a top-front-left perspective view of the intermediate converging nozzle and the housing outlet of the present invention, wherein the intermediate converging nozzle and the housing outlet are shown half cut to expose the internal hub.
Figure 13:
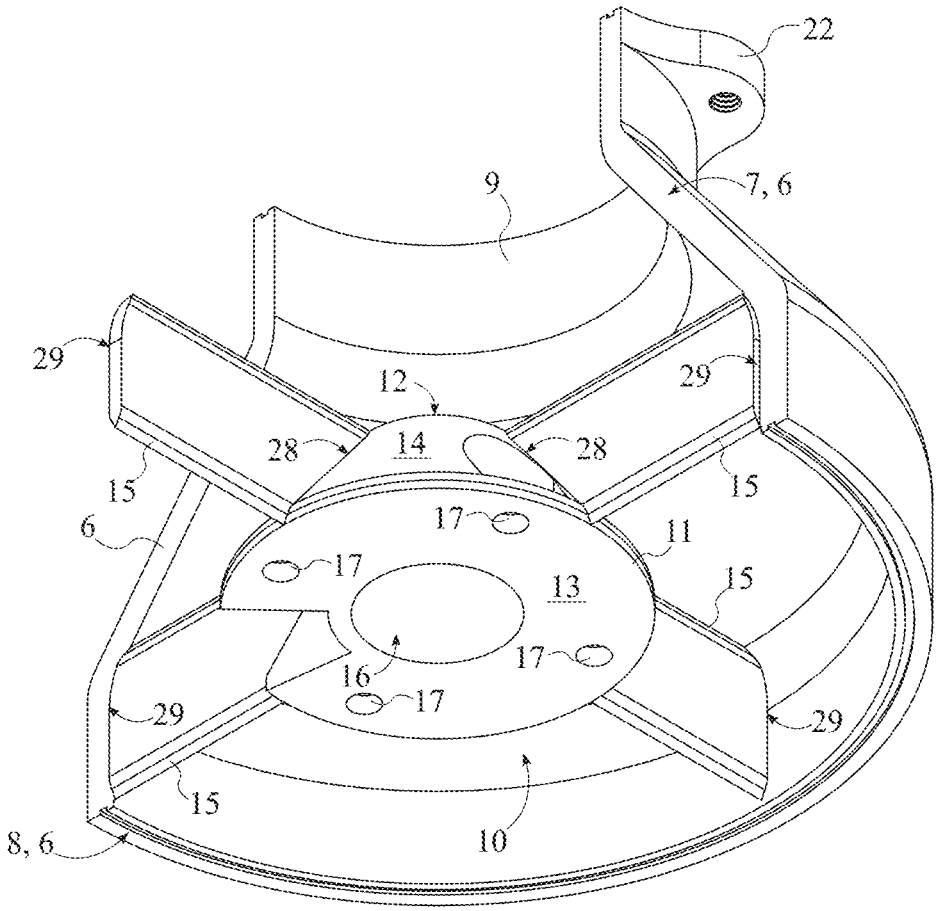
FIG. 13 is a front-bottom-left perspective of the intermediate converging nozzle and the housing outlet of the present invention thereof.
Figure 14:
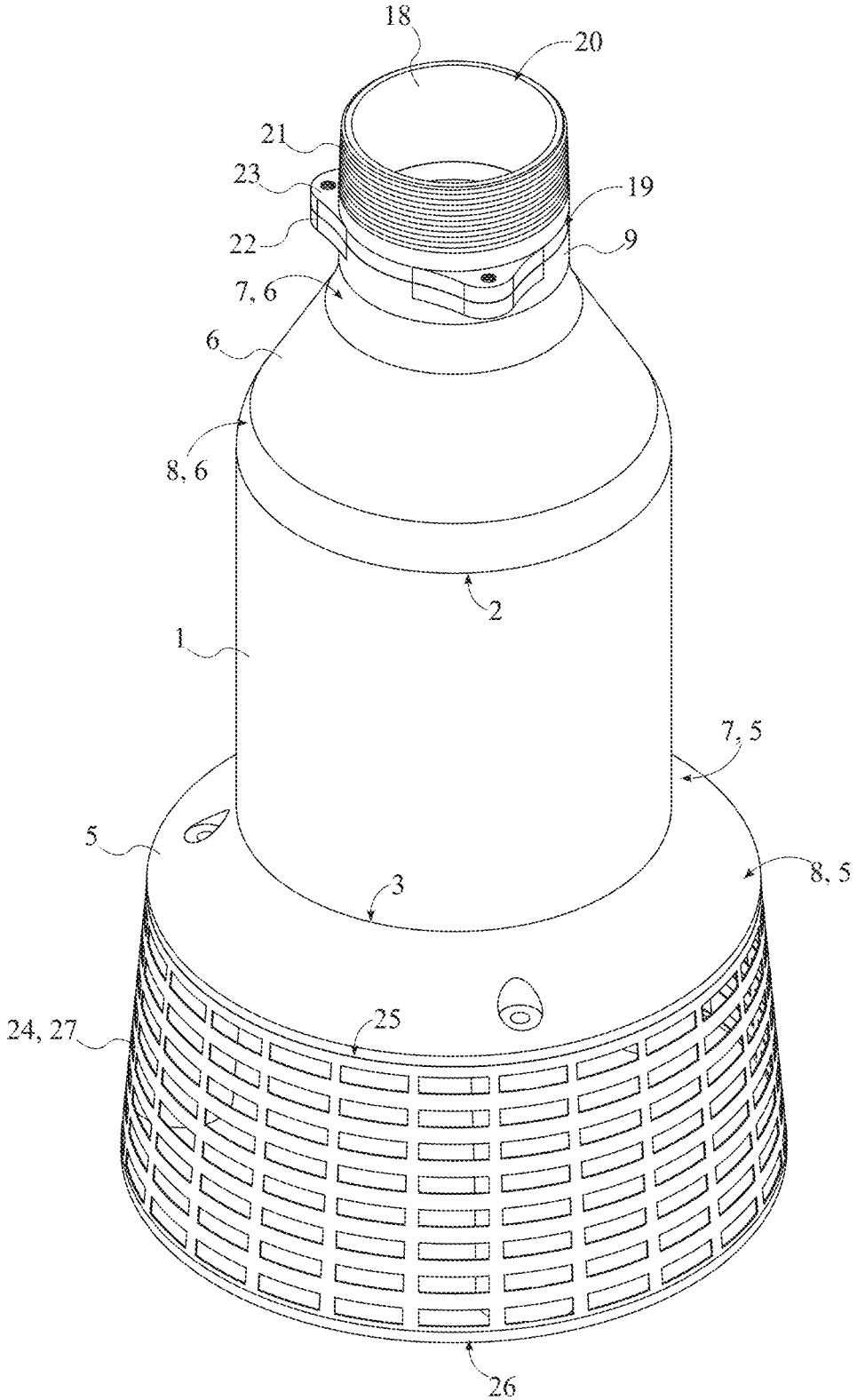
FIG. 14 is a top-front-left perspective view of an alternate embodiment of the present invention, wherein the submersible pump housing is shown with a tubular pipe adapter and a screen filter.
Figure 15:
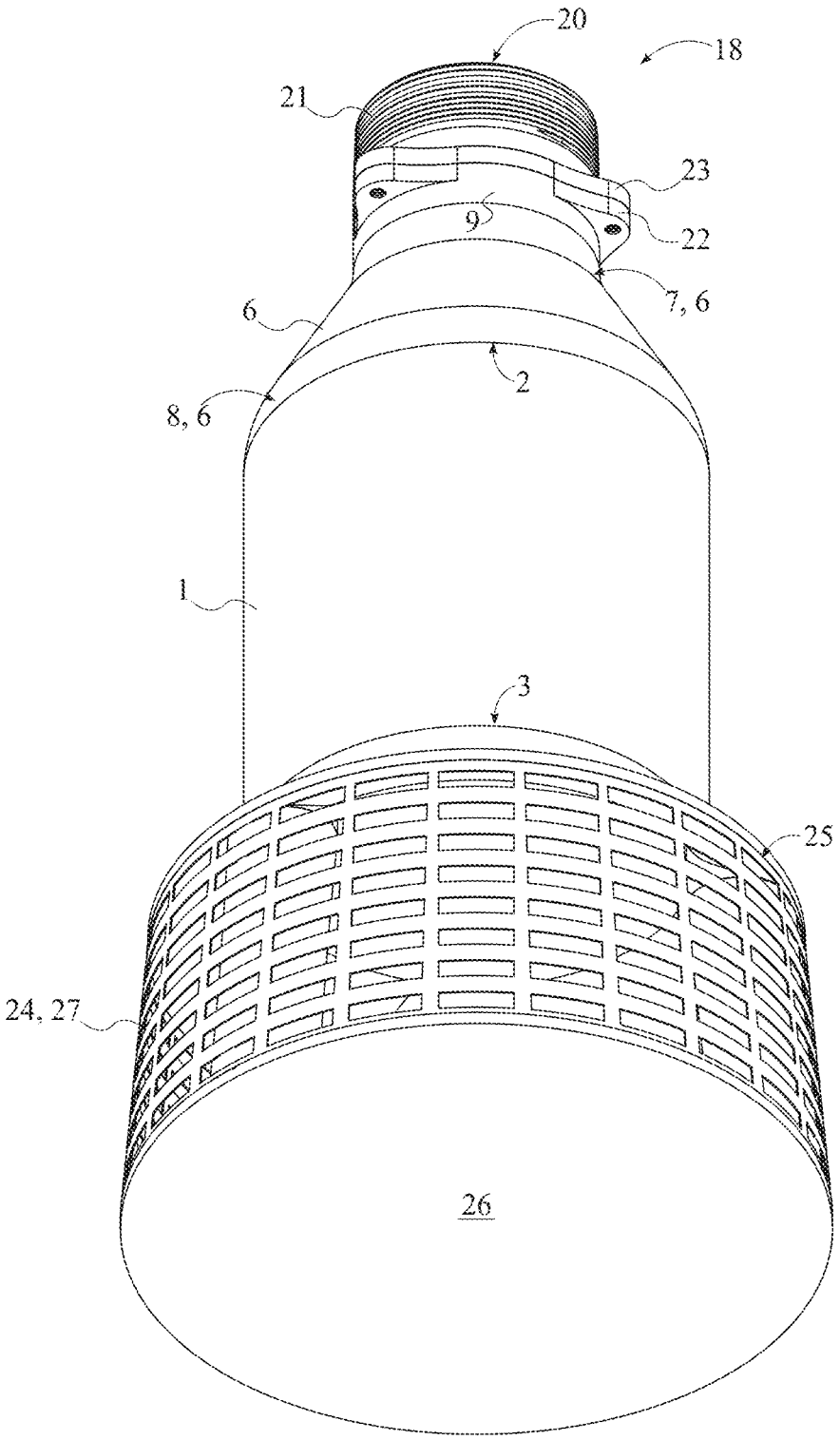
FIG. 15 is a bottom-rear-right perspective of the alternate embodiment of the present invention thereof.
Figure 16:
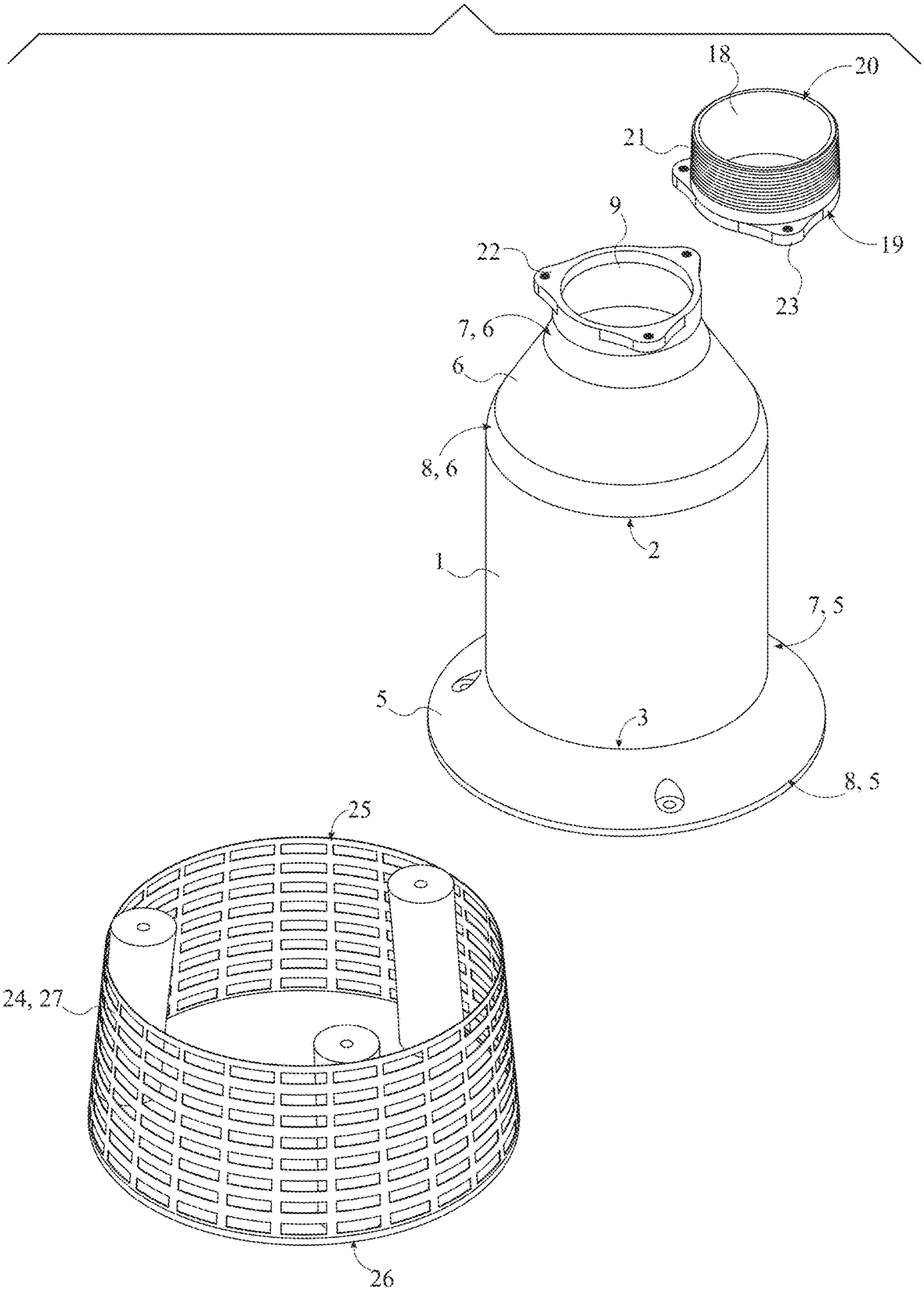
FIG. 16 is a top-front-left exploded perspective view of the alternate embodiment of the present invention thereof.
Figure 17:
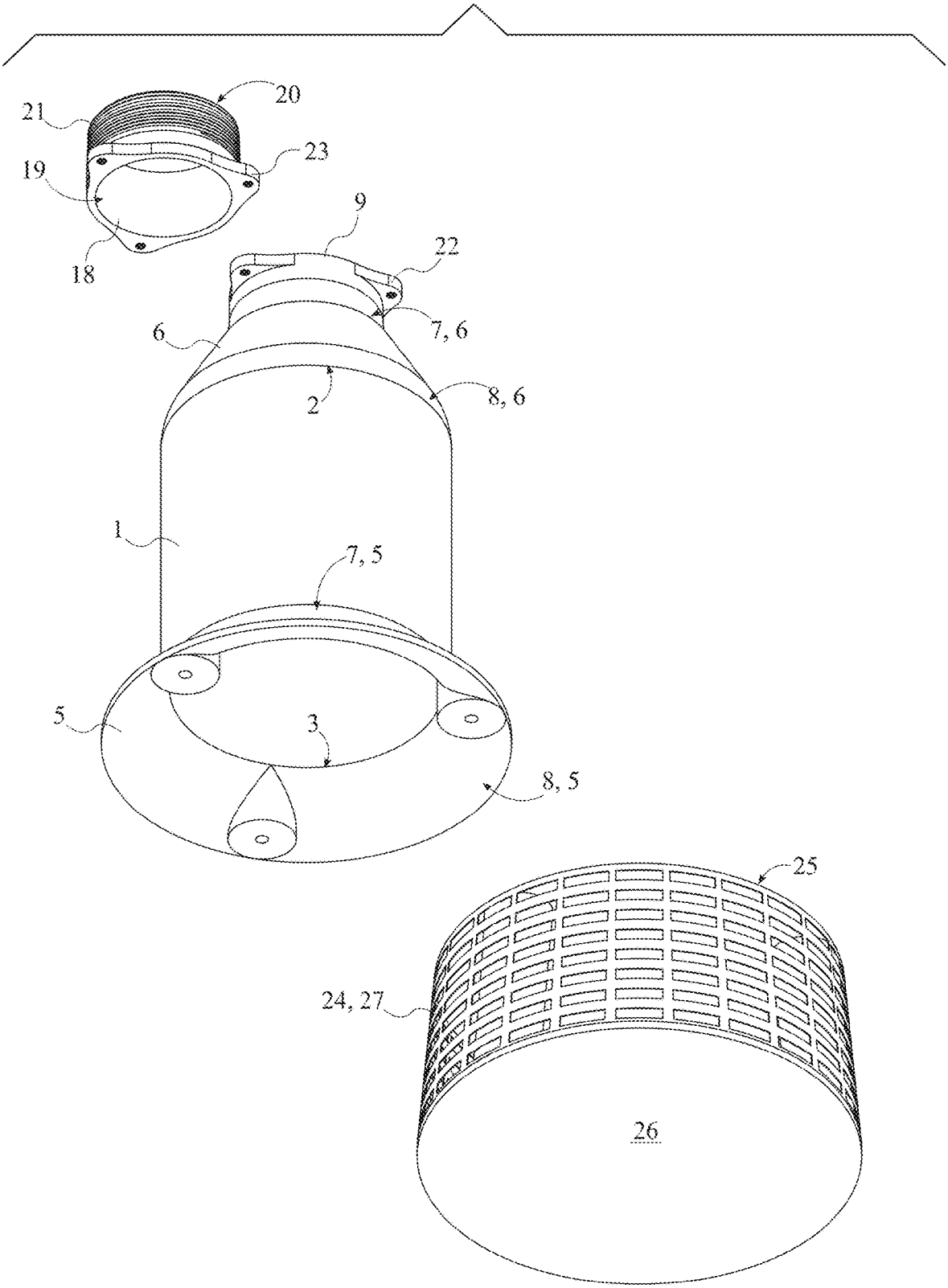
FIG. 17 is a bottom-rear-right exploded perspective view of the alternate embodiment of the present invention thereof.
Figure 18:
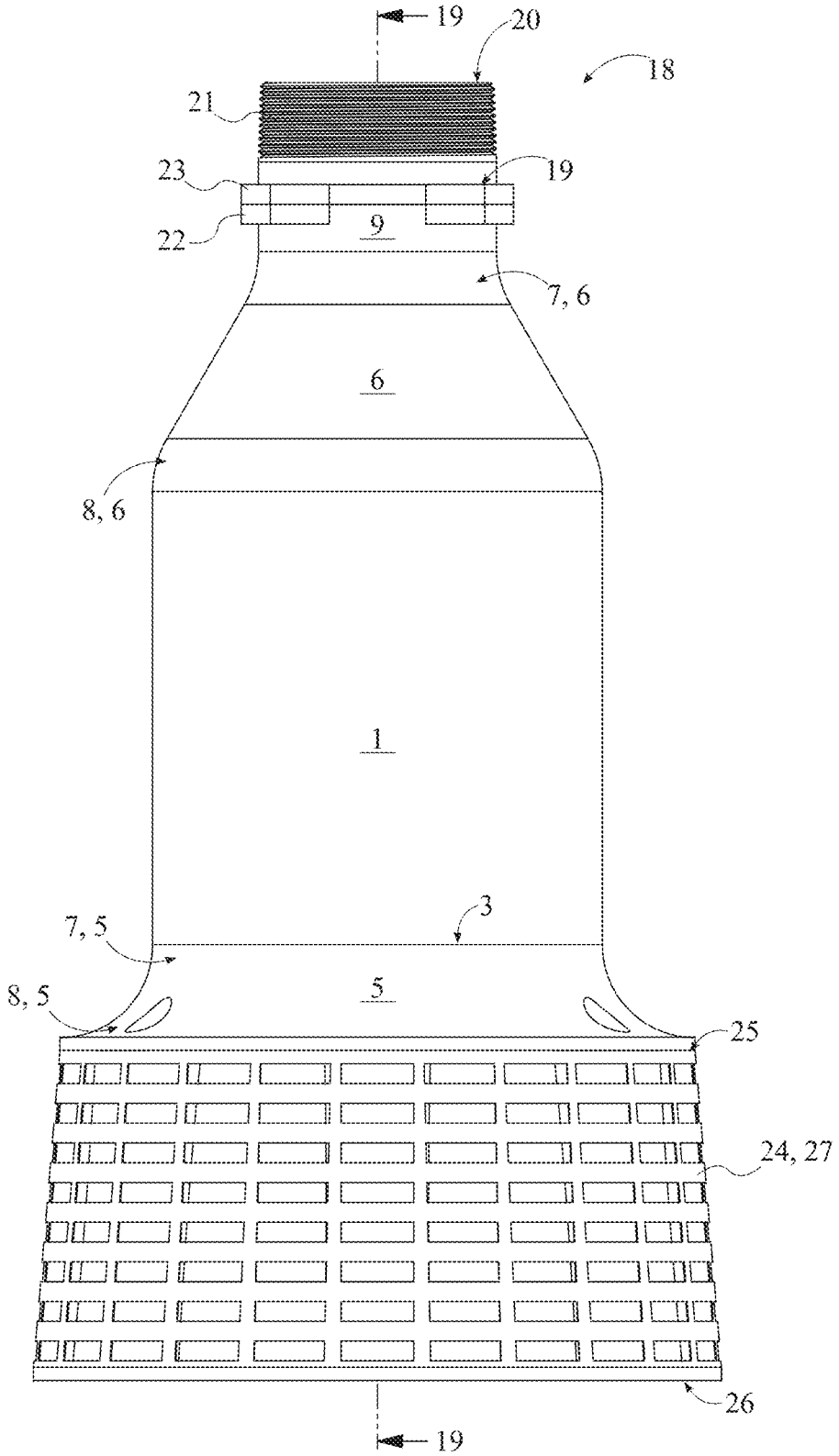
FIG. 18 is a front view of the alternate embodiment of the present invention thereof.
Figure 19:
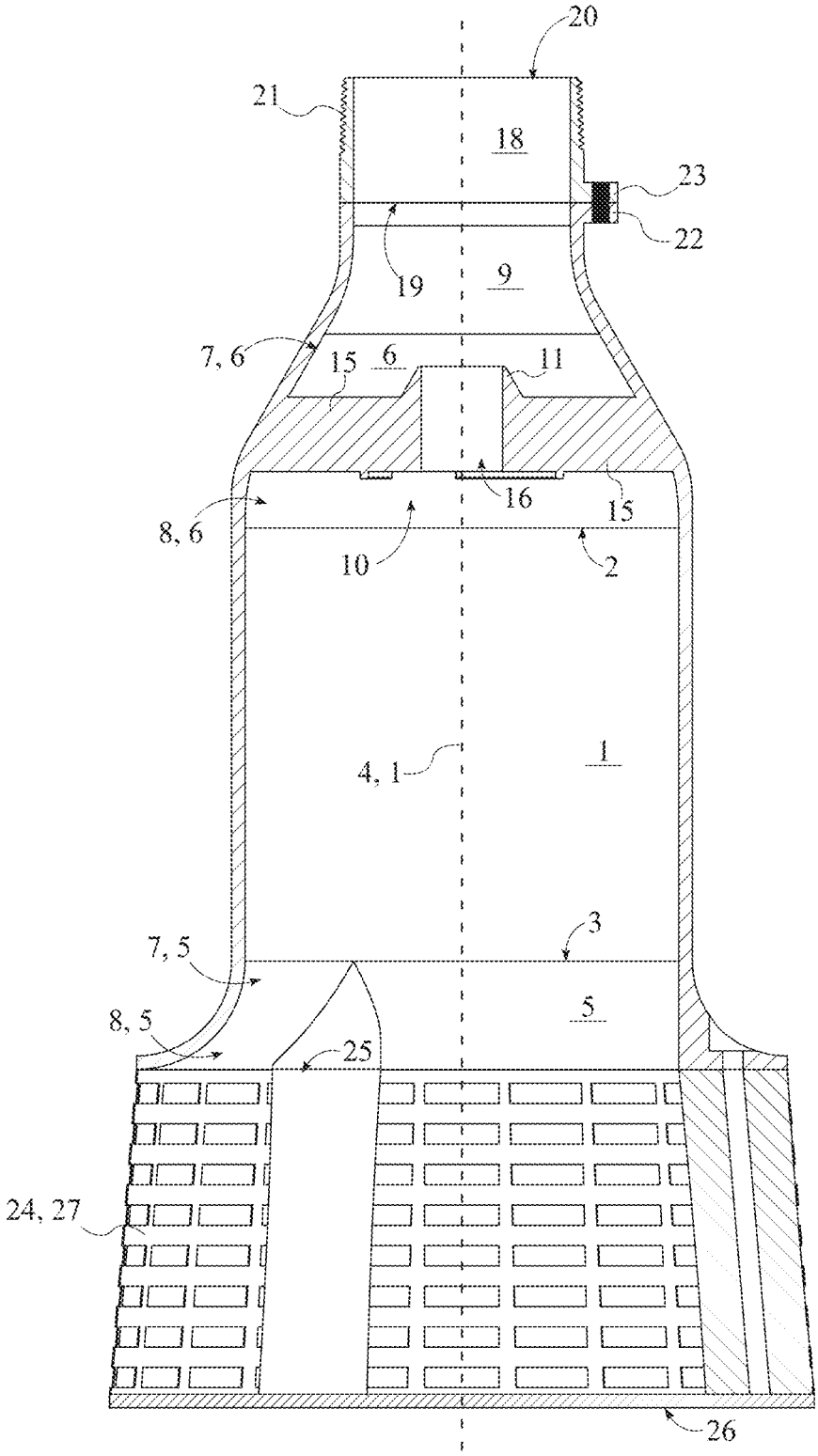
FIG. 19 is a cross-sectional view taken along line 19-19 in FIG. 18.

With the central channel 16 and the plurality of hub fastening features 17, the pump motor and the selected peller can be implemented without the corresponding functionalities being obstructed. In the preferred embodiment, the pump motor is installed by first positioning the motor shaft through the central channel 16, as can be seen in FIGS. 8 and 9. The pump motor is inserted through the inlet converging nozzle 5 until the housing of the pump motor contacts the distal conical base 13. Then, the appropriate fasteners are engaged into the plurality of hub fastening features 17 to secure the pump motor to the truncated conical body 11. On the other hand, the selected peller is positioned within the housing outlet 9. The peller hub of the selected peller is torsionally connected to the free end of the motor shaft. Further, the selected peller is especially designed to work with the present invention (i.e., U.S. patent Ser. No. 30/028,414 is incorporated by reference). Each of the peller blades is designed with the benefits of a propeller blade and an impeller blade. In other embodiments, the pump motor and the selected peller may be installed within the present invention using different mounting mechanisms.

The present invention is preferably designed as a modular structure that can be modified to match the desired specifications of the recirculating pump. So, each of the components of the present invention is designed as a modular component that can be exchanged to fit pellers and pump motors of various sizes, as can be seen in FIGS. 1 through 19. In addition, the present invention is designed to be removably attached to an external plumbing system so that the entire assembly can be removed from the external plumbing system for maintenance or other operational functions. To facilitate the removable connection of the present invention to an external plumbing system, the present invention may further comprise a tubular pipe adapter 18.

In the preferred embodiment, the tubular pipe adapter 18 is designed to connect to an external pipe. Different types of pipe adapters can be implemented according to the type of plumbing system the present invention is connected to. In general, the tubular pipe adapter 18 is a cylindrical adapter that connects the housing outlet 9 to the free end of the external pipe. As can be seen in FIGS. 1 through 19, the tubular pipe adapter 18 comprises a first open end 19 and a second open end 20 corresponding to the two opposite open ends of the tubular pipe adapter 18. To implement the tubular pipe adapter 18, the housing outlet 9 is in fluid communication with the first open end 19 to secure the tubular pipe adapter 18 to the housing outlet 9. In addition, the tubular pipe adapter 18 is concentrically positioned along the central axis 4 of the tubular casing 1. This way, the fluid flow moving out of the recirculating pump through the housing outlet 9 can move into the external pipe through the tubular pipe adapter 18.

While the first open end 19 is connected to the outlet housing, the second open end 20 can be connected to the external pipe, as can be seen in FIGS. 1 through 19. Different mechanisms can be implemented to facilitate the removable attachment of the tubular pipe adapter 18 to the external pipe. In the preferred embodiment, the present invention may comprise a male threading 21 that engages the female-threaded end of the external pipe. The male threading 21 is laterally connected around the tubular pipe adapter 18, adjacent to the second open end 20, to implement the male threading 21 on the outer surface of the tubular pipe adapter 18. This way, the user can attach the tubular pipe adapter 18 to the external pipe by engaging the male threading 21 into the female-threaded end of the external pipe. In other embodiments, different attachment mechanisms can be implemented for the tubular pipe adapter 18.

Similar to the male threading 21, an attachment mechanism can be implemented to removably mount the tubular pipe adapter 18 to the housing outlet 9. In the preferred embodiment, the present invention may further comprise an outlet fastener interface 22 and an adapter fastener interface 23, as can be seen in FIGS. 1 through 19. The outlet fastener interface 22 and the adapter fastener interface 23 allow the removable attachment of the tubular pipe adapter 18 to the housing outlet 9 using several fasteners. To implement the fastener interfaces, the outlet fastener interface 22 is laterally connected around the housing outlet 9, adjacent to the tubular pipe adapter 18. This way, the outlet fastener interface 22 is implemented on the housing outlet 9.

On the other hand, the adapter fastener interface 23 is laterally connected around the tubular pipe adapter 18, adjacent to the housing outlet 9, to implement the adapter fastener interface 23 on the tubular pipe adapter 18, as can be seen in FIGS. 1 through 19. To attach the adapter fastener interface 23 to the outlet fastener interface 22, the outlet fastener interface 22 and the adapter fastener interface 23 are concentrically positioned along the central axis 4 of the tubular casing 1. This maintains the cylindrical arrangement of the present invention. Further, the outlet fastener interface 22 and the adapter fastener interface 23 is attached to each other using the appropriate fasteners. Thus, the tubular pipe adapter 18 can be removably attached to the housing outlet 9. In other embodiments, different mechanisms can be implemented.

To improve the overall functionality of the present invention, different attachments can be further provided that be selectively attached to the present invention as necessary. In one embodiment, the present invention may further comprise a screen filter 24 that keeps out unwanted objects, materials, and contaminants from the entering the inlet converging nozzle 5, as can be seen in FIGS. 14 through 19. The screen filter 24 is also designed to elevate the inlet converging nozzle 5 from the ground to maintain the inlet converging nozzle 5 unobstructed. To attach the screen filter 24, the screen filter 24 is attached across the higher-pressure section 8 of the inlet converging nozzle 5. The design of the screen filter 24 is intended to be modular so that the user can selectively connect the screen filter 24 to the inlet converging nozzle 5.

Similar to the tubular pipe adapter 18, the screen filter 24 is designed to match the cylindrical structure of the present invention. In general, the screen filter 24 comprises an open filter end 25, a closed filter end 26, and an annular mesh body 27, as can be seen in FIGS. 14 through 19. The annular mesh body 27 corresponds to the main cylindrical structure of the screen filter 24. The open filter end 25 corresponds to the open end of the screen filter 24 that is attached to the inlet converging nozzle 5. The closed filter end 26 is the opposite end of the screen filter 24 that can be placed on the ground to elevate the reset of the cylindrical structure.

This embodiment of the screen filter 24 can be implemented as follows: the open filter end 25 and the closed filter end 26 are positioned opposite to each other about the annular mesh body 27 due to the cylindrical design of the screen filter 24, as can be seen in FIGS. 14 through 19. The open filter end 25 is in fluid communication with the higher-pressure section 8 of the inlet converging nozzle 5 to allow the fluid passing through the screen filter 24 to enter the inlet converging nozzle 5. The annular mesh body 27 is also concentrically positioned along the central axis 4 of the tubular casing 1 to maintain the cylindrical design of the present invention. In other embodiments, the screen filter 24 can be modified to filter out specific objects or to provide other functions to the present invention.

Although the invention has been explained in relation to its preferred embodiment, it is to be understood that many other possible modifications and variations can be made without departing from the spirit and scope of the invention.

What is claimed is:

1. A submersible pump housing comprising:
an inlet converging nozzle;
a tubular casing;
an intermediate converging nozzle;
a housing outlet;
an internal hub;
the inlet converging nozzle and the intermediate converging nozzle each comprising a lower-pressure section and a higher-pressure section;
the tubular casing comprising a proximal open end and a distal open end;
the lower-pressure section of the intake converging nozzle being in fluid communication with the distal open end;
the proximal open end being in fluid communication with the lower-pressure section of the intermediate converging nozzle;
the higher-pressure section of the intermediate converging section being in fluid communication with the housing outlet;
the internal hub being mounted within the intermediate converging nozzle, adjacent to the tubular casing; and
the inlet converging nozzle, the intermediate converging nozzle, the internal hub, and the housing outlet being concentrically positioned along a central axis of the tubular casing.

2. The submersible pump housing as claimed in claim 1 further comprising:
the internal hub comprising a truncated conical body;
the truncated conical body comprising a proximal conical base, a distal conical base, and a conical lateral wall;
the conical lateral wall tapering from the distal conical base to the proximal conical base;
the distal conical base being oriented towards the tubular casing;
the proximal conical base being oriented towards the housing outlet; and
the truncated conical body being concentrically positioned along the central axis of the tubular casing.

3. The submersible pump housing as claimed in claim 2 further comprising:
the internal hub comprising a plurality of support vanes;
each of the plurality of support vanes comprising a first vane end and a second vane end;
the plurality of support vanes being radially distributed around the truncated conical body;
the first vane end of each of the plurality of support vanes being connected onto the conical lateral wall; and
the second vane end of each of the plurality of support vanes being connected onto the intermediate converging nozzle.

4. The submersible pump housing as claimed in claim 2 further comprising:
the internal hub comprising a central channel;
the central channel traversing from the proximal conical base, through the truncated conical body, and out of the distal conical base; and
the central channel being concentrically positioned along the central axis of the tubular casing.

5. The submersible pump housing as claimed in claim 2 further comprising:
the internal hub comprising a plurality of hub fastening features;
the plurality of hub fastening features being radially distributed around the truncated conical body; and
each of the plurality of hub fastening features being integrated in between the conical lateral wall and the distal conical base.

6. The submersible pump housing as claimed in claim 1 further comprising:
a tubular pipe adapter;
the tubular pipe adapter comprising a first open end and a second open end;
the housing outlet being in fluid communication with the first open end; and
the tubular pipe adapter being concentrically positioned along the central axis of the tubular casing.

7. The submersible pump housing as claimed in claim 6 further comprising:
a male threading; and
the male threading being laterally connected around the tubular pipe adapter, adjacent to the second open end.

8. The submersible pump housing as claimed in claim 6 further comprising:

an outlet fastener interface;

an adapter fastener interface;

the outlet fastener interface being laterally connected around the housing outlet, adjacent to the tubular pipe adapter;

the adapter fastener interface being laterally connected around the tubular pipe adapter, adjacent to the housing outlet;

the outlet fastener interface and the adapter fastener interface being concentrically positioned along the central axis of the tubular casing; and the outlet fastener interface and the adapter fastener interface being attached onto each other.

9. The submersible pump housing as claimed in claim 1 further comprising:

a screen filter; and the screen filter being attached across the higher-pressure section of the inlet converging nozzle.

10. The submersible pump housing as claimed in claim 9 further comprising:

the screen filter comprising an open filter end, a closed filter end, and an annular mesh body;

the open filter end and the closed filter end being positioned opposite to each other about the annular mesh body;

the open filter end being in fluid communication with the higher-pressure section of the inlet converging nozzle; and the annular mesh body being concentrically positioned along the central axis of the tubular casing.

* * * * *